United States Patent [19]

Yamaguchi et al.

[11] Patent Number: 4,636,789

[45] Date of Patent: Jan. 13, 1987

[54] METHOD FOR DRIVING A MATRIX TYPE DISPLAY

[75] Inventors: Hisashi Yamaguchi, Atsugi; Kazuhiro Takahara, Kawasaki; Hiroyuki Gondoh, Kawasaki; Toyoshi Kawada, Kawasaki; Shizuo Andoh, Kawasaki, all of Japan

[73] Assignee: Fujitsu Limited, Kawasaki, Japan

[21] Appl. No.: 533,986

[22] Filed: Sep. 20, 1983

[30] Foreign Application Priority Data

Sep. 21, 1982 [JP] Japan ..... 57-165461
Jun. 10, 1983 [JP] Japan ..... 58-103869

[51] Int. Cl.[4] ..... G09G 3/30
[52] U.S. Cl. ..... 340/805; 340/781
[58] Field of Search ..... 340/753, 754, 781, 805, 340/784

[56] References Cited

U.S. PATENT DOCUMENTS 4,237,456 12/1980 Kanatani ..... 340/719
4,338,598 7/1982 Ohba et al. ..... 340/781 X
4,465,999 8/1984 Tsuzuki et al. ..... 340/754 X

FOREIGN PATENT DOCUMENTS 2105085 3/1983 United Kingdom .

OTHER PUBLICATIONS

Proceedings of the Society for Information Display, vol. 22, No. 1, 1981, pp. 57–62, Los Angeles, CA, US; M. Takeda et al., "Practical Application Technologies of the Thin-Film Electroluminescent Panels".

*Primary Examiner*—Gerald L. Brigance
*Assistant Examiner*—Vincent P. Kovalick
*Attorney, Agent, or Firm*—Staas & Halsey

[57] ABSTRACT

In driving a thin film EL display panel providing the matrix arrangement of translucent data electrodes and metal scanning electrodes, the data pulse is supplied to the selected translucent data electrodes in such a relation that it rises in advance of the scanning pulse to be supplied to the opposing metal scanning electrodes. Thereby, fluctuation of brightness due to the influence of electrode resistance of the translucent data electrodes can be eliminated, and a uniform and distinct display can be attained.

16 Claims, 12 Drawing Figures

METHOD FOR DRIVING A MATRIX TYPE DISPLAY

BACKGROUND OF THE INVENTION

This invention relates to an improved method for driving a matrix type display panel in which capacitive display cells are arranged in the form of a matrix, and more specifically to a new method for driving a display panel such as a thin film electroluminescence (EL) display device in such a manner that fluctuations in the brightness of the light that is emitted, caused by the influence of electrode resistance, can be alleviated.

As a matrix display device wherein capacitive display cells are arranged in the form of a matrix, a display panel having the structure of a plurality of scanning electrodes and a plurality of data electrodes are arranged in orthogonal directions opposite each other on both sides of a display medium such as an EL material or a discharge gas, with each plurality of electrodes being on an insulating layer, is very popular. As an example, an AC-driven type of thin film EL display panel generally provides a multi-layer thin film structure as shown in FIG. 1(A). Namely, the panel 10 has a structure such that a translucent data electrode 2 is provided on a translucent glass substrate 1, an EL layer 4 such as ZnS:Mn sandwiched by the insulating layers 3, 5 from both sides is placed thereon, and a metal scanning electrode 6 like Al is provided on the upper insulation layer 5. The data electrode 2 and scanning electrode 6 are arranged in a matrix in mutually orthogonal directions, the display cells 7 are defined at the intersection points of the opposing electrodes and the selected display cells emit light upon receiving a combined voltage of a scanning pulse selectively applied to both electrodes and a data pulse. For such a panel structure, the following refresh drive method is employed. Namely, the entire surface is address-scanned on the lines on a time-shared basis with such a selection pulse and then the address points are caused to emit the light again by applying in common a refresh pulse with a polarity opposite to that of said selection pulse.

However, in case of an EL display panel of such a structure, the electrode resistance of the translucent electrodes on the substrate side to be used generally as the data electrodes 2 inevitably becomes higher than the electrode resistance of the metal scanning electrode 6 on the rear side. A translucent electrode is usually formed as a mixed vacuum-deposited film of tin oxide and indium oxide (ITO), and such a translucent electrode has a comparatively high resistance. Therefore an electrode resistance of about 20 kΩ results for an electrode length of 200 mm as in the case of forming a display panel of 1000×1000 cells with five electrodes per 1 mm and with each electrode having a width of 0.15 mm. As a result, when a panel having a large scale display area is to be driven, some different is generated in the rising waveforms of data pulses as between the display cell at the connection end of the data driver that is, in the (nearest cell) and the display cell furthest apart from the connection end (furthest cell), and accordingly the brightest of the emitted light is different.

Such a conventional problem is explained in more detail by referring to the panel model view of FIG. 1(B), the panel equalizing circuit of FIG. 2 and the driving voltage waveforms of FIGS. 3(a) to (h). In this case, each figures shows, as an example, that the display cell group related to the data electrode $D_1$ is selected for light emission. In FIG. 1(B), 1 is the substrate, $D_1 \sim D_{1000}$ are translucent data electrodes, $S_1 \sim S_{1000}$ are metal scanning electrodes, $S_n$ is the display cell nearest to the data power supply (hereinafter referred to as the nearest cell within the panel), $S_f$ is the display cell furthest from the data power supply (hereinafter referred to as the furthest cell within the panel). Moreover, in FIG. 2, rd is the resistance value of the data electrode per cell, and CS is the cell capacitance. As is obvious from FIG. 2, the effective circuit of the panel electrode resistance and panel cell capacitance observed from the driving end of the data electrode $D_1$ forms a ladder circuit, there is a large difference in the CR time constant at the ports nearer to and the ports further from the data power supply. Therefore, a data voltage pulse DP supplied from the data power supply to the data electrode $D_1$ as shown in FIG. 3(*a*) is directly applied to the electrode nearest to said power supply as the half-selection voltage in the waveform shown in FIG. 3(*b*), but is applied to the furthest electrode as the half-selection voltage the rising edge of which is dulled as shown in FIG. 3(*c*). Therefore, a remarkable difference appears in the rising edges of the combined voltage at the full selection time when a half selection scanning voltage pulse SP is applied to the scanning electrodes $S_1$ to $S_{1000}$ as indicated in FIGS. 3(*d*) to (*f*). Namely, a difference occurs between the voltage waveform $PS_n$ as in the nearest cell Sn within the panel of FIG. 3(*g*) and the voltage waveform $PS_f$ of the furthest cell $S_f$ within the panel as shown in FIG. 3(*h*) The problem particularly arises in that the furthest cell $S_f$ cannot obtain a sufficient voltage for emitting the light and therefore brightness is lowered below that of the nearest cell $S_n$, and accordingly the brightness of the light fluctuates over the entirety of the display cells.

On an actual EL display panel, the output terminals of the transparent electrodes are alternately placed along two opposing edges of the panel and connected to the drivers. Therefore, the nearest and furthest cells from the drivers alternate in a line along the edge of the panel, and the brightness nonuniformity of their display cells is obvious.

If electrode length and size are different, such a problem also occurs even when the same material is used for the electrodes (for example, a longer electrode has a higher electrode resistance).

SUMMARY OF THE INVENTION

It is therefore an object of this invention to provide a method of driving a display panel providing matrix electrodes having different resistance values with decreased fluctuation of the brightness of the emitted light.

It is another object of this invention to provide an improved method for driving a large scale matrix display panel which realizes a distinct display with uniform brightness for the entire display surface.

It is a further object of this invention to provide a new method for driving capacitive display cells which can reduce the power consumption required for selective operation of a large number of display cells.

Briefly, this invention is characterized by that a selected voltage is supplied across the selected display cells, for providing the electro-optical display effect in a matrix display panel in which the data and scanning electrode are provided with different resistance values, such that the selected voltage has two stages of its rising waveform. The first part of the waveform rises sufficiently before the second part to alleviate the influence of the electrode resistance of the electrode having a larger resistance value, and the second part of the rising waveform is combined with said first part to provide a full selection effect. As a result, a combined voltage waveform to be applied to the furthest cell within the panel becomes sharp at the full selection time, which waveform is almost the same as the combined voltage waveform at that time in the nearest cell within the panel. Therefore, fluctuation of the brightness as between the two cells can be eliminated.

According to the second characteristic of this invention, when addressing is carried out successively to adjacent display cells on the same data electrode, the same data pulse height is supplied continuously to the same data electrode while a plurality of scanning electrodes related to the pertinent adjacent display cells are scanned. Thereby, unwanted power consumption caused by an intermittent data pulse for addressing successively the adjacent display cells can be reduced. Accordingly, since the data pulse is applied in advance of a scanning pulse applied to the scanning electrodes, the fluctuations of brightness due to the influence of electrode resistance in the data electrode side can also be eliminated.

DESCRIPTION OF THE PREFERRED EMBODIMENTS

Figure 3:
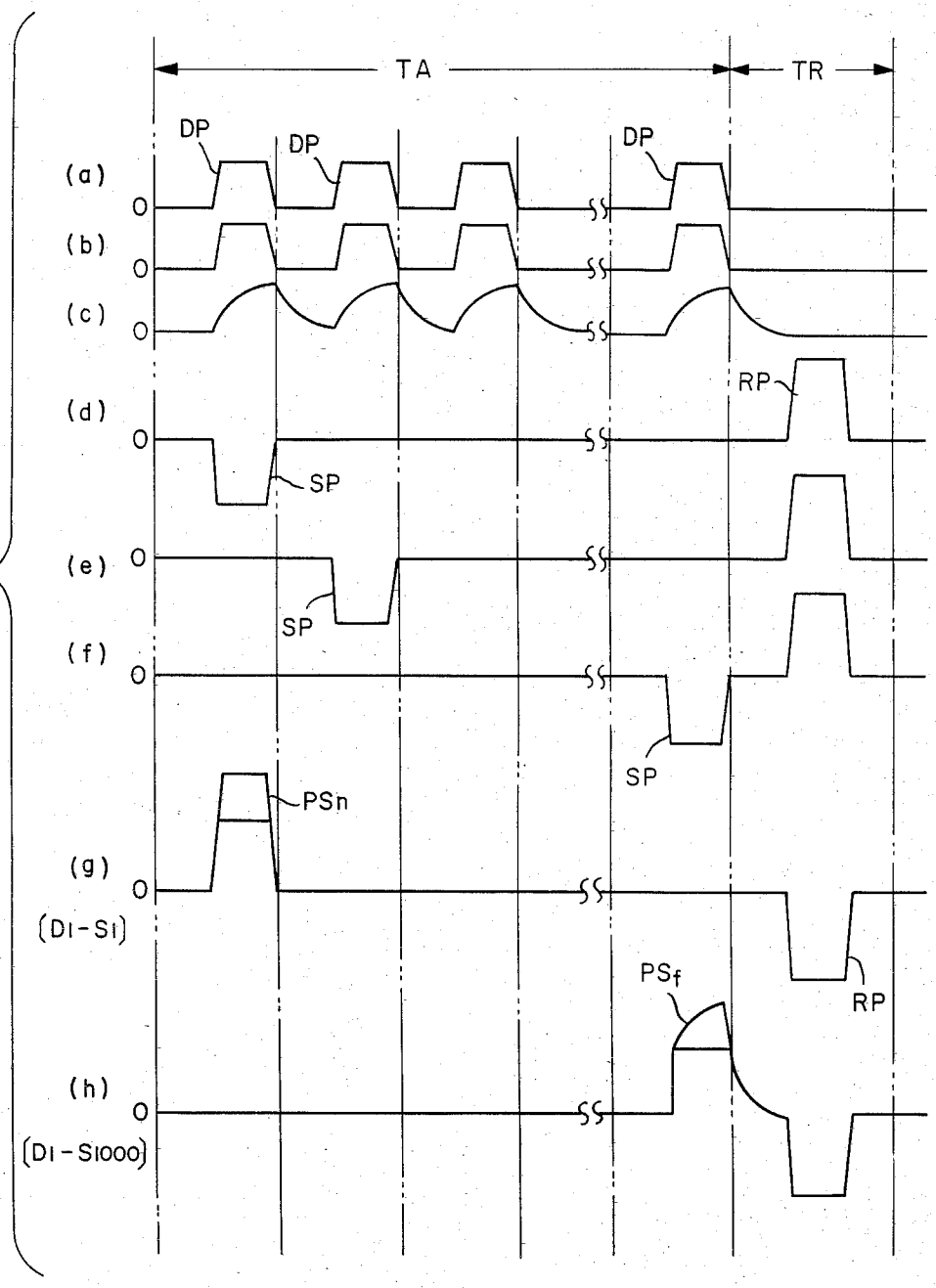
FIGS. 3(*a*) to (*h*) show waveforms of conventional driving voltages.
Figure 4:
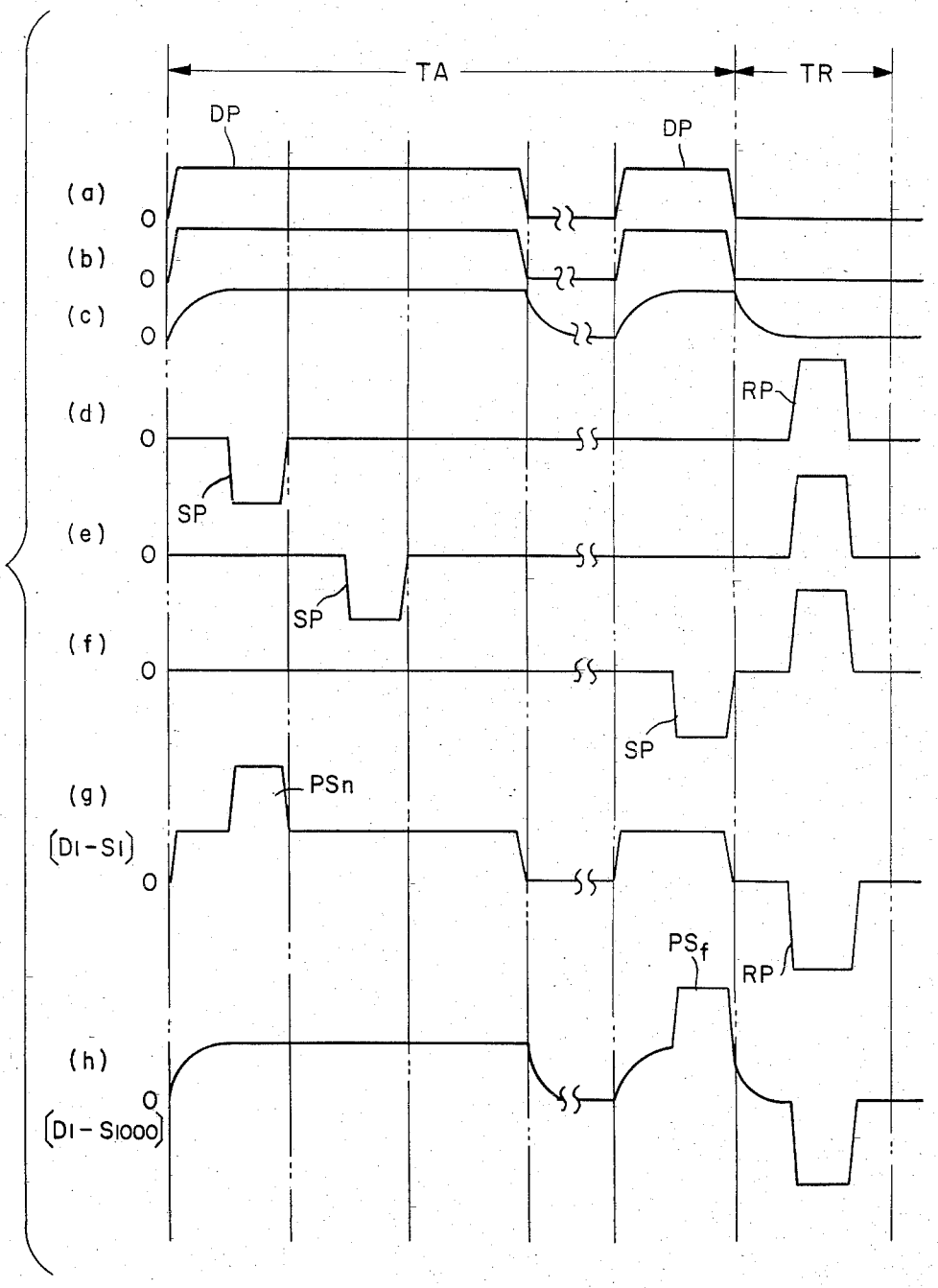
FIGS. 4(*a*) to (*h*) show driving voltage waveforms for explaining an embodiment of this invention.

An embodiment of this invention is explained in detail by referring to the drive voltage waveforms of FIGS. 4(*a*) to (*h*). The example of driving voltage waveforms shown in FIG. 4(*a*) also causes the display cell group corresponding to the translucent data electrode $D_1$ to selectively emit light as in the case of the driving waveform example of FIGS. 3(*a*) to (*h*), but the waveforms applied to the different data electrodes as shown in FIGS. 4(*b*) and (*c*) are remarkably different from those of FIGS. 3(*b*) and (*c*). Namely, a data voltage pulse DP to be applied as a half selection voltage to the display cell group along the selected data electrodes has a waveform with a pulse width that is applied during the address (write) period (16 usec, for example) for one display line, in order to realize earlier rising than the scanning voltage pulse SP to be applied as a half selection voltage to the display cell group along the selected scanning electrode. More concretely, such a data voltage pulse DP is applied to the data electrode 8 usec in advance of the rise of the scanning voltage pulse SP.

Therefore, a data voltage pulse applied to the data electrode on the furthest cell $S_f$ within the panel is dulled at the rising edge as shown in FIG. 4(*c*), but a specified voltage is reached at the time of full selection when the scanning voltage pulse is applied to the corresponding scanning electrode $S_{1000}$. In other words, as shown in FIG. 4(*h*), a voltage pulse $PS_f$ applied to the furthest cell $S_f$ within panel has the two stages in its rising waveform, namely the data voltage DP which is applied in advance as the first voltage part and the scanning voltage SP superimposed thereon as the second voltage part. Thus the voltage across the furthest cell becomes almost same waveform as the applied voltage pulse $PS_n$ for the nearest cell $S_n$ within the panel shown in FIG. 4(*g*) at the time of full selection. Therefore, the brightness at the pertinent furthest cell $S_f$ is no longer lowered by the influence of electrode resistance and there is little difference in the brightness between the nearest and furthest cells within the panel. In FIGS. 4(*a*) to (*h*), TA includes the address for all the cells along one data line and TR is the refresh period. During the refresh period, the address pulse and the refresh pulse RP of reverse porality are simultaneously applied to all display cells.

In the above embodiment, the data voltage pulse as the first voltage part above is given a pulse width corresponding to one cell address time and therefore rises well in advance of the scanning voltage pulse which is supplied as the second voltage part as described above.

When considering only the prevention of uneven brightness as explained above, the rise time of the data pulse can also be set a little slow in accordance with the size and characteristics of a panel, because it is sufficient that the data pulse rises in advance, insofar as the influence of the electrode resistance in the translucent data electrode side is concerned. However, as explained above, in the system utilizing the data pulse having a full address time width, the switching of a data driver can conveniently be omitted for obtaining continuous light emission of the adjacent display cells on the same data electrode.

Figure 5:
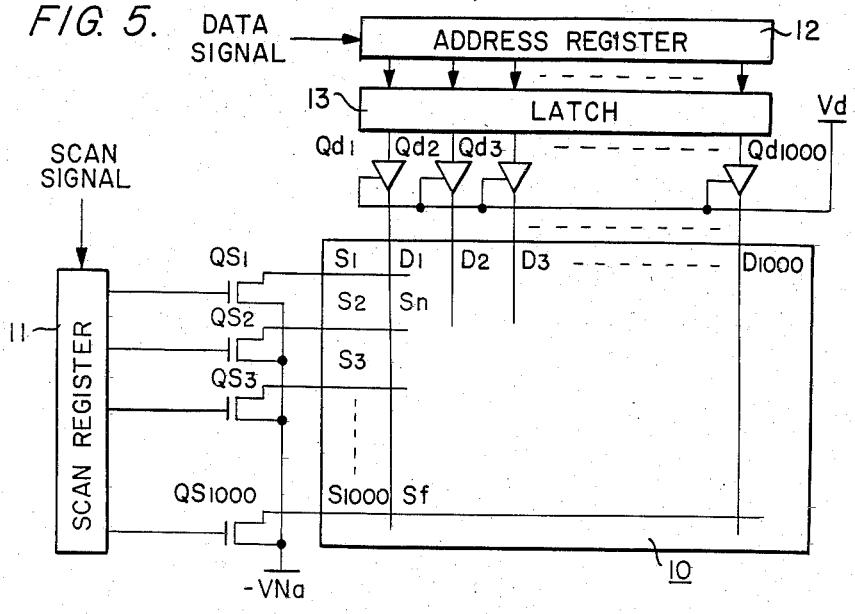
FIG. 5 is a block diagram of a drive circuit of another driving method.

FIG. 5 is a block diagram of an EL panel drive circuit for realizing such a driving method.

The Y side metal scanning electrodes $S_1 \sim S_{1000}$ of a thin film EL display panel 10 are connected with the scanning drivers $Q_{s1} \sim Q_{s1000}$ which are sequentially driven by the scanning signal sent from the scanning shift register 11, and thusly each is connected to the scanning voltage $-V_{Na}$. The X side translucent data electrodes $D_1 \sim D_{1000}$ extending in the vertical direction of the display panel 10 are connected with the data drivers $Q_{d1} \sim {}_{d1000}$ connected to the address voltage $V_a$. These data drivers corresponding to the data electrodes are driven in parallel on a timeshared basis with a signal for each data line being sent from the latch circuit 13 which temporarily stores the parallel address signals sent from the shift register 12 for the data addresses.

According to such a structure, the latch circuit 13 for storing the address signal is inserted into the address circuit in the data electrode side and therefore the address signal for the data driver can be maintained in the same condition so long as the address of the next line does not change, even as the inputting and outputting of the series address signal for all the scanning lines along each data electrode occurs via the shift register 12. Namely, the latch circuit 13 provides, for example, the flip-flop corresponding to each data driver and thereby the output condition can be changed in accordance with address data being set to each bit of the shift register 12. Accordingly, when continuous light emission of the adjacent display cells along the same data electrode is required, the content of the bits corresponding to the shift register 12 becomes the same for the relevant adjacent scanning lines, the output of the latch circuit 13 also does not change, and the corresponding data drivers can be driven continuously.

Figure 6:
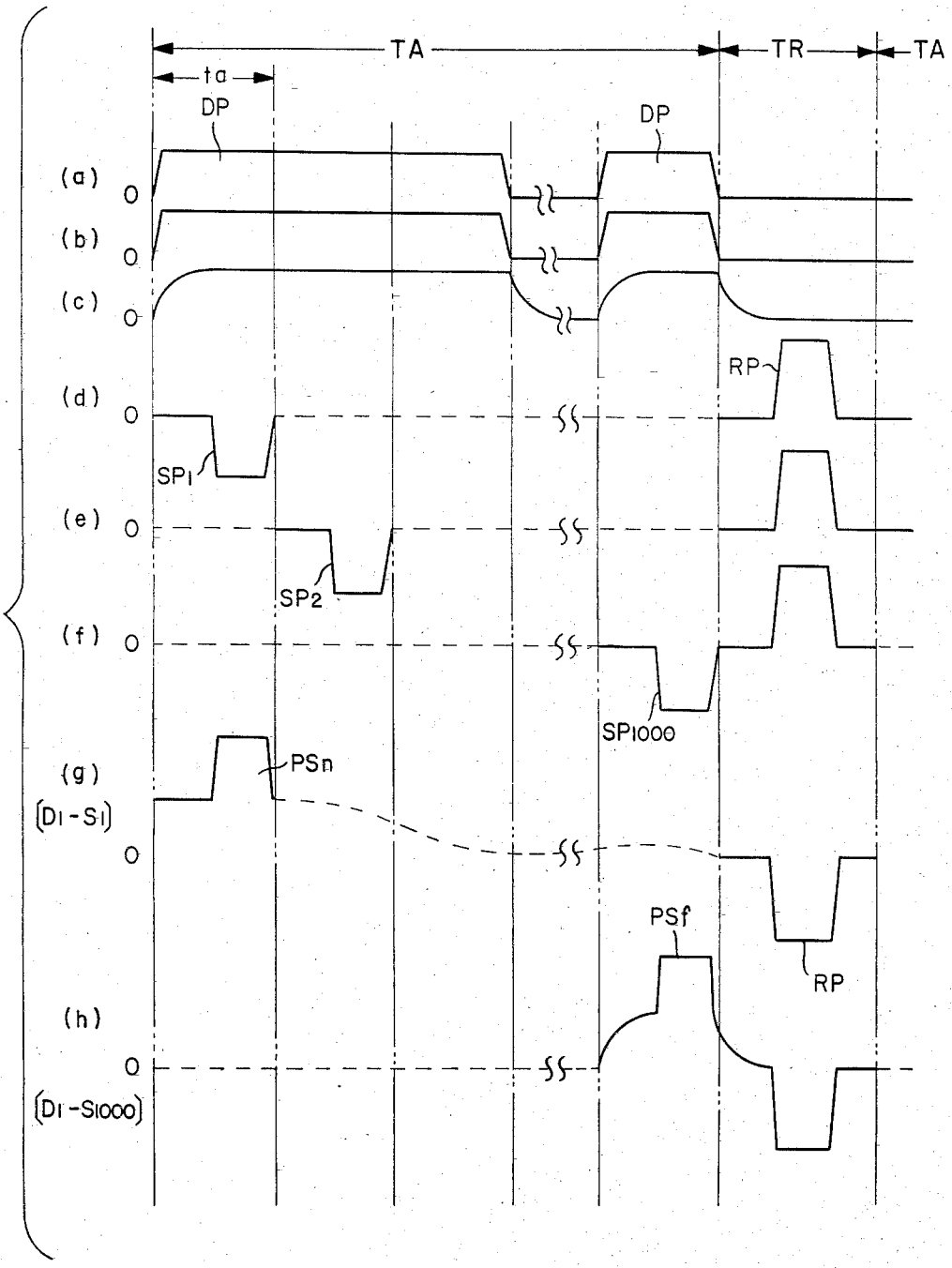
FIGS. 6(*a*) to (*h*) show driving voltage waveforms utilizing the driving circuit of FIG. 5.

FIGS. 6(*a*) to (*h*) show driving voltage waveforms in this embodiment. As in the case of FIGS. 4(*a*) to (*h*) FIG. 6(*a*) is an output voltage waveform of a data pulse DP supplied to the selected translucent data electrodes from the data driver; (b) is a data pulse waveform to be supplied to the nearest cell Sn to the connecting end of data driver; (c) is a data pulse waveform to be supplied to the furthest cell $S_f$ from the connecting end of the driver; (d)~(f) are waveforms of the scanning pulses SP to be supplied to the scanning electrodes from the scanning driver; (g) is a combined voltage waveform to be supplied to the nearest cell $S_n$ as the address pulse $PS_n$; and (h) is a combined voltage waveform to be supplied to the furthest cell $S_f$ as the address pulse $PS_f$, respectively. TA is the address period and TR is the refresh period. During this refresh period, the address pulse and the refresh pulse RP with opposite polarities are applied in common to all the electrodes and thereby the address points emit the light again.

As is obvious from the operating voltage waveforms, particularly from the waveform of the data pulse DP of FIG. 6(*a*), when it is required, for example, to address continuously adjacent display cells on the same data electrode extending over the first, second and third scanning electrodes $S_1$, $S_2$ and $S_3$, etc, the address pulse DP is supplied continuously to the pertinent data electrodes during the first three unit address periods. Namely, during this period, the switching OFF of the data driver for each unit address period ta is not carried out. As a result, useless charging and discharging current that is consumed for driving the data driver each time even when the same data is continued, in order to input or output the address data to the shift register for each unit address period ta in synchronization with the scanning period.

Of course, in this case, the data pulse DP to be applied to a high resistance translucent data electrode occurs in advance of the scanning pulse applied to the low resistance metal scanning electrode. Therefore, a combined address voltage waveform rises sufficiently with a waveform such as shown in FIG. 6(*h*) even at the furthest cell, and uneven brightness due to influence of electrode resistance can be eliminated.

If non-selected scanning electrodes are clamped to ground potential while addressing occurs for the the cells to display as explained above, unwanted charging current flows into the cells incorporating the non-selected scanning electrodes during the rise of the data pulse DP and useless power is consumed. In this case, therefore, it is convenient to prevent flow of useless charging current by always keeping the non-selected scanning electrodes in the floating condition and giving a high impedance thereto. In the waveforms of FIGS. 6(*a*) to (*h*) a dotted lines indicate the floating voltage, and the potential of the non-selected scanning electrodes is floated in accordance with the selecting condition of the opposing data electrodes. When the resistance of the scanning electrodes is higher than the resistance of the data electrodes, the rise of the scanning pulse accordingly precedes the rise of the data electrode.

In the above embodiment, the selecting operation is carried out by applying positive and negative half-selecting voltage pulses respectively to both the data electrode and the scanning electrode. However, the voltage levels supplied to the two selecting electrodes can be set freely and relatively within a range of a combined voltage at which the selected cells are capable of giving a full selection effect.

Figure 7:
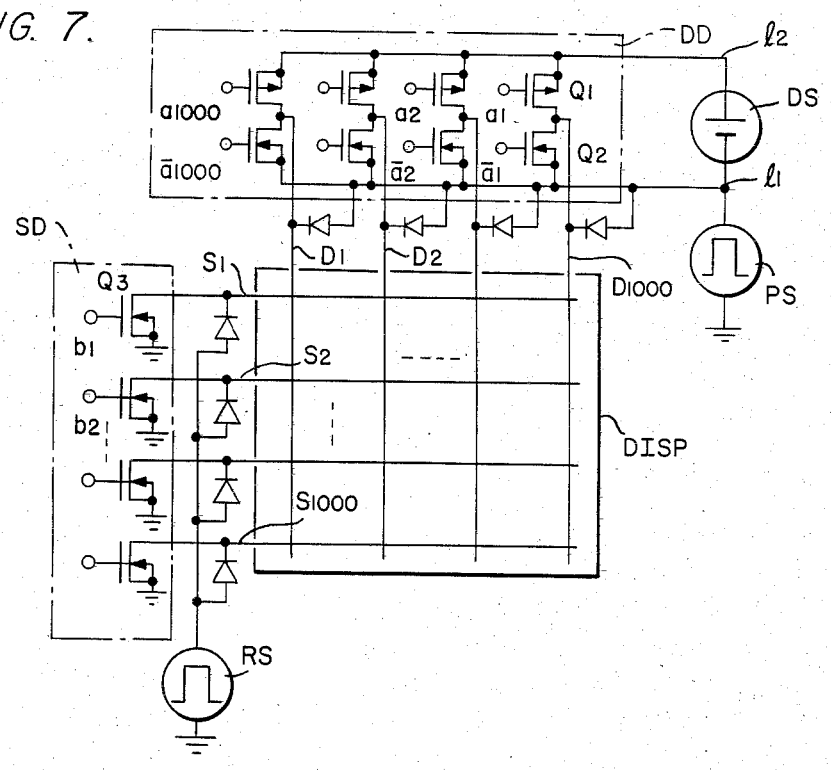
FIG. 7 is a structure of the drive circuit of another driving method.

A drive circuit for an EL display panel as shown in FIG. 7 is considered as another embodiment. In FIG. 7, the line driver DD for data is composed of the driving transistors $Q_1$, $Q_2$ paired corresponding to the data electrodes $D_1 \sim D_{1000}$, and the respective input terminals $(a_1, \bar{a}_1)$, $(a_2, \bar{a}_2)$ . . . are given respective reverse data. On the other hand, the like driver SD for scanning is provided with the scanning transistors $Q_3$ corresponding to respective scanning electrodes $S_1 \sim S_{1000}$.

The input terminals $b_1$, $b_2$, . . . of the scanning transistors $Q_3$ are sequentially given scanning data and such transistors are accordingly sequentially driven to the ON state, thus, connecting the corresponding scanning electrodes $S_1$, $S_2$, . . . to ground potential.

The not-selected scanning electrodes are maintained in the floating condition since the respective scanning transistor $Q_3$ is in the OFF state.

While the scanning electrodes $S_1$, $S_2$, . . . are sequentially selected and driven, a bias pedestal pulse PP with a voltage $V_p$ is supplied from the bias power source PS through the first power supply line $l_1$ for each selection of the respective scanning electrodes $S_1$, $S_2$, . . . and the display data corresponding to the scanning electrodes $S_1$, $S_2$, . . . selected by the control equipment (not shown) are given to the input terminals $(a_1, \bar{a}_1)$, $(a_2, \bar{a}_2)$, . . . .

To produce light output, the P channel MOS transistors $Q_1$ are set to the "ON" state and the N channel MOS transistors $Q_2$ are set to the "OFF" state by applying low level signals to both input terminals $a_1$, $a_2$ . . . and e,ovs/a/ $_1$, $\bar{a}_2$ . . . at the same time.

On the other hand, if it is desired not to produce light output, the respective transistors $Q_1$ and $Q_2$ are set to "OFF" and "ON" states respectively, by applying high level signals to the respective input terminals.

As a result, the data pulse DP of a voltage $V_D$ is supplied to the data electrodes $D_1$, $D_2$, . . . which are required to emit the light, through the second power line $l_2$ from the data power supply DS in such a form as to be superimposed on the bias pedestal pulse PP. Thereby, on the display panel DISP, the display cells at the intersecting points of the selected scanning electrodes, namely between the scanning electrodes connected to ground potential and the data electrodes to which the data pulse DP is superimposed, emit the light.

Such operations are sequentially carried out for the scanning electrodes $S_1$, $S_2$, . . . and after the final scanning electrode $S_{1000}$ is selected and driven, the refresh pulse RP is given to all display cells from the refresh power source RS connected in common to the scanning electrodes. When this refresh pulse is applied, charges, which accumulated in the light emitting layer of the display cells which emitted light according to the data pulses, flow in the reverse direction to that during emission of light, and only the addressed display cells emit the light again.

Figure 8:
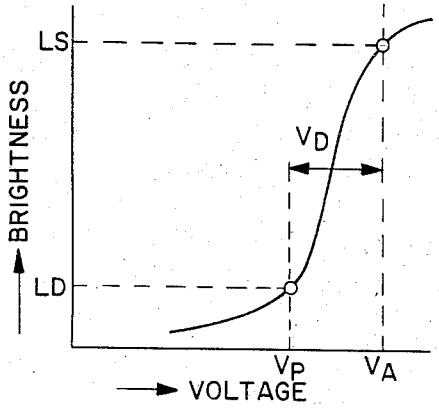
FIG. 8 is a characteristic curve indicating the relationship between voltage and brightness of an EL display panel.

Here, the general light emitting characteristic of an EL display panel is shown in FIG. 8. Only a low brightness level LD can be obtained when said bias pedestal pulse PP is applied and any change therein hardly be detected visually. Meanwhile, when the data pulse DP is superimposed, a high brightness level LS can be obtained, resulting in a bright display effect.

Figure 1A:
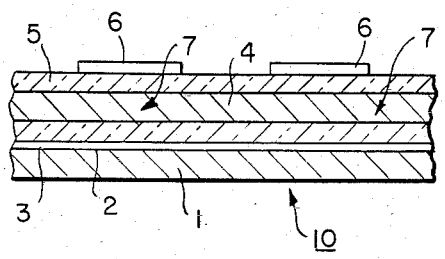
FIG. 1(A) is a partial cross-section of an ordinary EL display panel.
Figure 1B:
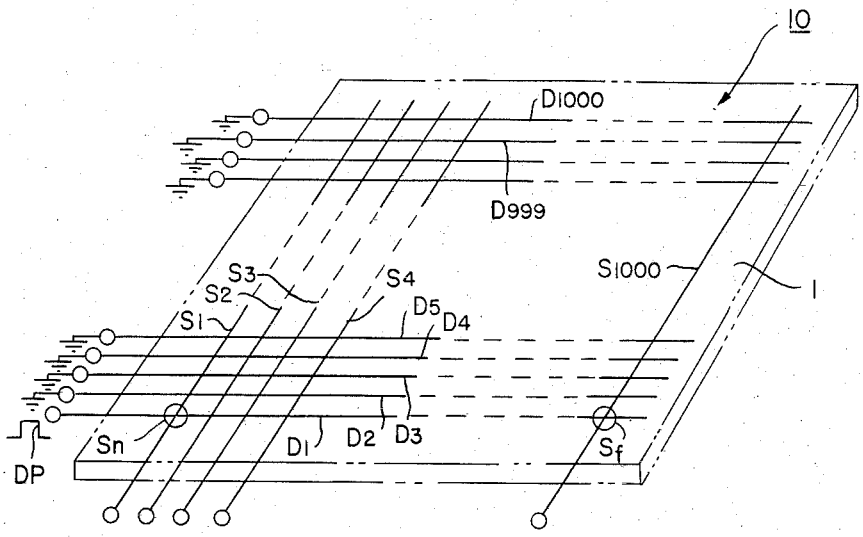
FIG. 1(B) is a perspective model view indicating the arrangement of the electrodes of a conventional EL display panel.
Figure 2:
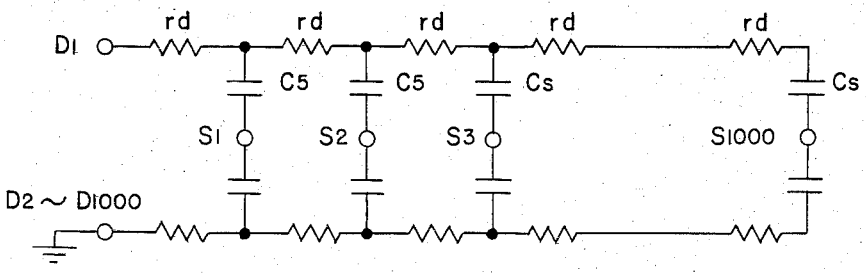
FIG. 2 is an equivalent circuit viewed from the end portion of one data electrode of the panel shown in FIG. 1(B)

In the case wherein the data electrodes $D_1 \sim D_{1000}$ are formed by a translucent conductive film in the above driving circuit with high electrode resistance, the load as viewed from the line driver for data and the load as viewed from the bias power source become great. Namely, the load viewed from the line driver for data forms a ladder type RC circuit having panel electrode resistance rd and panel cell capacitance $C_s$ as in the case of the equivalent circuit of FIG. 2 referred to previously. Therefore, as viewed from the dimer, there is a large difference in the CR time constants of the nearer and further portions of the line driver for data.

Figure 9:
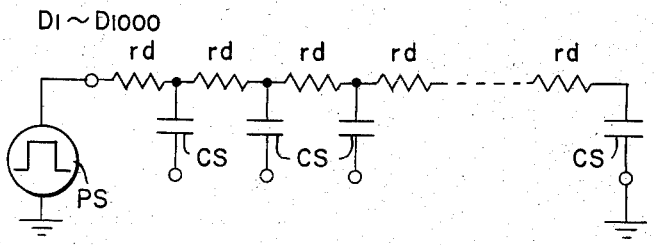
FIG. 9 is an equivalent circuit diagram of a panel load viewed from the bias power supply of FIG. 7.

On the other hand, an equivalent circuit of the load as viewed from the bias power source PS is shown in FIG. 9. Thus, a CR time constant of the furthest cell as viewed from the line driver is expressed as $1000^2$ rd Cs/2, while a CR time constant of the furthest cell as viewed from the bias power source becomes 1000 rd Cs.

Figure 10:
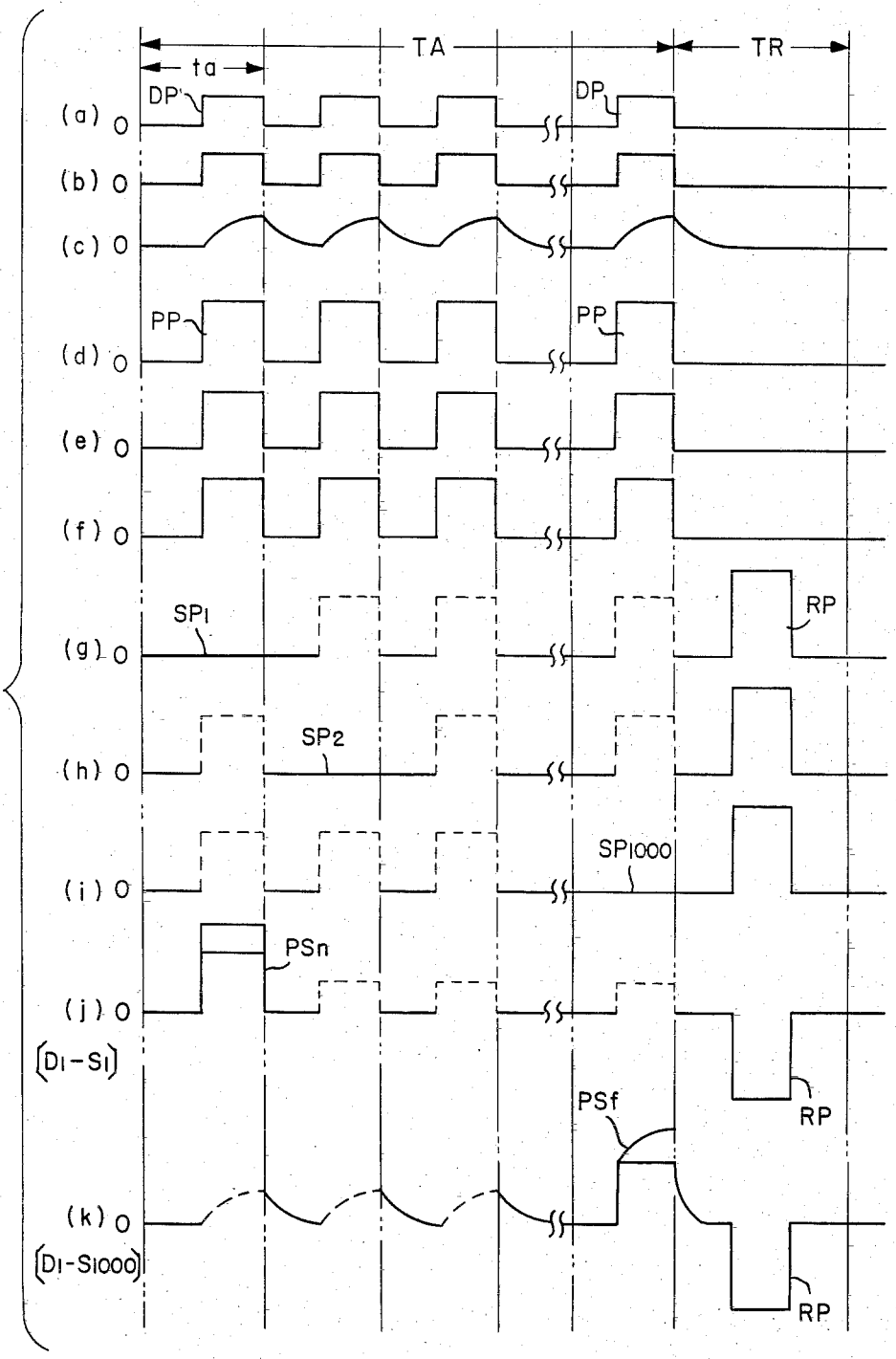
FIGS. 10(*a*) to (*h*) show driving voltage waveforms in a conventional driving method.

As a result, with reference to the voltage waveforms shown in FIGS. 10(*a*) to (*h*), the data pulse DP of FIG. 10(*a*) supplied to the data electrode $D_1$ from the line driver for data and the bias pulse PP of FIG. 10(*d*) supplied from the bias power supply are applied as the pulses having almost the same rising profile as in FIGS. 10(*b*) and (*e*) at the electrode portions nearer to the driver, but are applied at the furthest electrode as the pulses where the data pulse DP is remarkably dulled at its rising edge as in FIGS. 10(*c*) and (*f*). Therefore, a significant difference in the rising profile of the light emitting voltage appears between the voltage waveform $PS_n$ of the nearest cell $S_n$ within the panel as shown in FIG. 10(*j*) from the combination of the respective scanning voltage pulse $SP_1$, $SP_{1000}$ of the scanning electrodes $S_1$ to $S_{1000}$ of FIGS. 10(*g*) and (*i*) and a voltage waveform $PS_f$ of the furthest cell $S_f$ within the panel as shown in FIG. 10(*k*). Particularly, the furthest cell $S_f$ cannot receive a voltage which is sufficient for the light emission, which results in the brightness being lower than that of the nearest cell $S_n$. Thus, disadvantage results that the brightness fluctuates for all display cells as in the case of FIGS. 3(*a*) to (*h*).

Therefore, in the case of a driver circuit as shown in FIG. 7 is being used, according to this invention, a driving method wherein is employed the data pulse DP on the data line rises in advance of the bias pulse PP on the scanning line.

Figure 11:
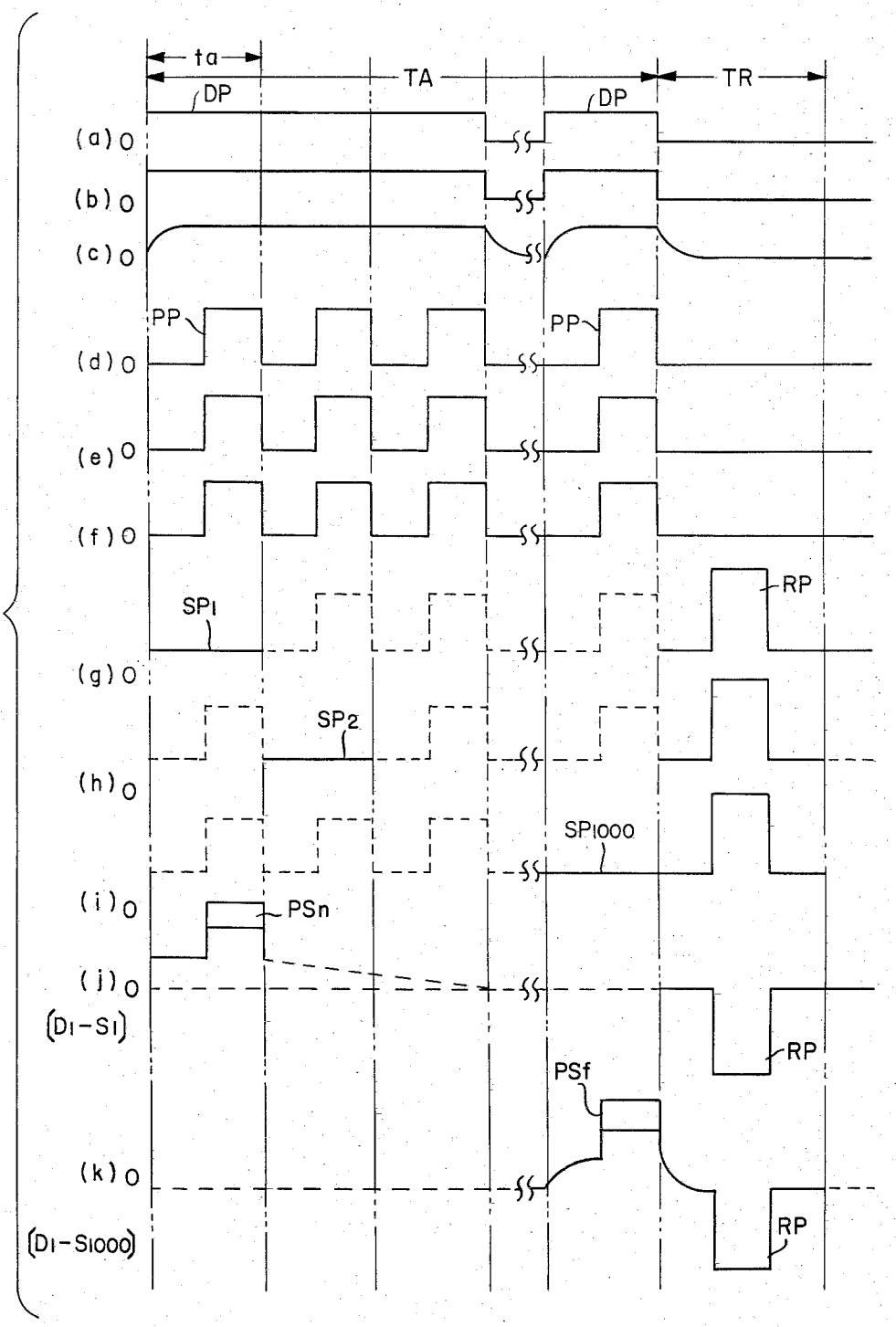
FIGS. 11(*a*) to (*h*) show voltage waveforms for explaining a driving method of an embodiment of the present invention.

FIGS. 11(*a*) to (*h*) show the driving voltage waveforms used in the present invention, wherein the voltage pulse waveforms output from the line driver DD for data are remarkably different as compared with those in FIGS. 10(*a*) to (*c*). Namely, a data voltage pulse DP shown in FIG. 11(*a*) has a waveform with a pulse width so that it is applied during the address (write) period ta (16 usec, for example) of one display line in order to rise earlier than the bias pulse PP. More concretely, such a data pulse DP is applied to the data electrode 8 usec in advance of the rise of the bias pulse PP.

Therefore, the data pulse applied to the data electrode on the furthest cell $S_f$ within the panel is dulled at the rising edge as shown in FIG. 11(*c*), but reaches the predetermined light emitting voltage when the bias pulse PP is applied under the condition that the scanning voltage pulse $SP_{1000}$ is applied to the corresponding scanning electrode $S_{1000}$, namely ground voltage is applied. Therefore, the voltage pulse $PS_f$ applied to the furthest cell $S_f$ within the panel becomes, as shown in FIG. 11(*k*), almost the same as the voltage pulse $PS_n$ applied to the nearest cell $S_n$ within the panel as shown in FIG. 11(*j*), and the pertinent furthest cell $S_f$ can emit the light with the best condition, namely in a high brightness. Thereby, there is little difference between the light emitting brightness of the nearest cell and of the furthest cell within the panel.

Also in this embodiment, for the case of the adjacent display cells on the same data electrode being caused to continuously emit light, as shown in FIGS. 11(*a*) to (*c*), it is desirable to use a waveform bridging between the preceding and succeeding data pulses, from the viewpoint of low power consumption in driving. Particularly, considering that such display data are often used in order to display actual characters or figures, the above waveforms can be very effective for practical use.

Moreover, in the above embodiment, it is presumed that the data electrode has the higher resistance, but in the case of the scanning electrode having the higher resistance, the fluctuation of brightness can also be prevented by reversely setting the waveform timing of the data pulse and bias pulse.

As is obvious from the above explanation, in short, this invention provides a desired display effect, on the occasion of giving the full selection voltage to the selected cells, by causing the first voltage part to rise sufficiently in advance of a second part, for alleviating the influence of electrode resistance and for applying the second voltage part at the full selection time in such a manner that it is superimposed on said first voltage part. Thereby, the cell voltage waveforms applied to the nearest cell and to the furthest cell within the panel become almost the same at the full selection timing, and uniform brightness can thusly be obtained at all the display cells. Accordingly, the display quality of a panel can be improved drastically. Therefore, it is very effective to employ this invention in a large size EL display panel. In addition, power consumption can be significantly reduced in the case of displaying actual characters or figures.

What is claimed is:

1. A method for driving a matrix display panel having opposing scanning and data electrodes defining intersection points thereof, each of said scanning electrodes having a first resistance value and each of said data electrodes having a second resistence value, wherein a respective display cell is defined at each said intersection point of said opposing electrodes, said method comprising applying a selection voltage in a first addressing period, via respective ones of said scanning and data electrodes, across at least one selected one of said display cells corresponding to a first one of said scanning electrodes, for causing an electro-optical display effect across each said selected display cell of said first scanning electrode, and similarly applying said selection voltage across selected display cells of successive other ones of said scanning electrodes in respective subsequent addressing periods, in a predetermined order of said scanning electrodes, wherein each said selection voltage is provided to have a waveform that rises in two stages, the first stage having a first rising part for changing to a predetermined value the relative potential of the one of the two opposing electrodes of each said selected display cell of the respective addressing period which has the larger of said first and second resistance values prior to the rising of the second stage, and the second stage having a second rising part which is applied uniformly across all of said display cells of at least the scanning line of the respective addressing period and which is combined with said first rising part to uniformly provide said electro-optical display effect in each said selected display cell in the respective addressing period, irrespective of its position along each said scanning and data electrode.

2. The method of claim 1, wherein said data electrodes are translucent and have higher resistance than said scanning electrodes, the providing of each said first stage with said first rising part comprises selectively applying a first voltage to one end of each said data electrode of a selected display cell during the respective addressing period, and the providing of each said second stage with said second rising part comprises applying a half-select pulse to one end of the respective scanning electrode at a later time during each respective addressing period.

3. The method of claim 2, wherein when successive display cells along the same data electrode are selected in successive addressing periods for said electro-optical display effect, a voltage for providing said waveform of said first stage is supplied continuously to the same respective data electrode during said successive addressing periods.

4. A method for driving an electroluminescent display panel having an array of display cells defined at intersection points of opposing scanning and data electrodes having different first and second resistance values respectively, wherein one of said resistance valves is higher than the other, said method comprising selectively applying, for each of a plurality of successive addressing periods, a first voltage to the respective electrode having the higher resistance among the data and scanning electrodes of each selected one of said display cells having in common a respective one of said electrodes having the lower resistance value and subsequently, while maintaining said first voltage during the same addressing period, applying a second respective voltage to said respective electrode having the lower electrode resistance, wherein said first and second respective voltages together provide during each said addressing period a voltage of a predetermined level to cause an electro-optical effect at each said selected display cell during the respective addressing period.

5. A method for driving an electroluminescent display panel having a light emitting layer between opposing scanning and data electrodes with respective first and second resistances of different values, wherein one of said resistance values is higher than the other, said opposing electrodes defining at their intersections a matrix of display cells, said electrodes being capacitively coupled across each said display cell by said light emitting layer, said method comprising the steps of applying a selection pulse voltage of a specified level across selected ones of said display cells, including supplying a first selection pulse to each of the higher resistance electrodes of said selected display cells corresponding to a first one of said electrodes having the lower resistance value, supplying a second selection pulse sufficiently later in time selectively to the respective lower resistance electrode of each of said selected display cells, so that the uniformity of display by said selected display cells does not depend upon the position of any of said display cells along each respective high resistance electrode, and maintaining the non-selected ones of said lower resistance electrodes in a floating condition.

6. A method for driving a matrix display panel including a display medium layer and opposing scanning and data electrodes which are coupled capacitively to said display medium layer so as to define a matrix of display cells at respective intersections of said scanning and data electrodes, wherein an electro-optical display effect is obtained by applying a display voltage of a specified level across selected ones of said display cells, said data electrodes having higher resistance than said scanning electrodes, said method comprising the steps of sequentially supplying a reference voltage to each of said scanning electrodes with respectively selected scanning drivers; and supplying each said data electrode with a common bias voltage from a first voltage means, and selectively supplying a further voltage to selected ones of said data electrodes from a second voltage means according to whether light emission or no light emission is desired of the respective display cells;

wherein the respective voltage given to each said selected data electrode from said second means rises in advance of said common bias voltage from said first voltage means, and the rise time of said common bias voltage as applied to said data electrodes is faster than the rise time of said further voltage from said second voltage means as applied to said data electrodes of said selected display cells.

7. The method for driving a matrix display panel according to claim 6, wherein adjacent ones of said display cells along a first selected one of said data electrodes are caused to emit light, and said further voltage is applied continuously from said second means so as to cause said further voltage on said first selected data electrode from said second means to rise in advance of the occasion of causing adjacent display cells on the same data electrode to emit light.

8. A method for selecting each display cell of a plurality of display cells arranged in rows and columns in a matrix to provide a desired display, each said display cell being defined between opposing portions of first and second pluralities of electrodes, said first electrodes being aligned along said columns and said second electrodes being aligned along said rows, the resistance of said first electrodes being greater than the resistance of said second electrodes, and said opposing portions of the first and second electrodes of each said display cell being capacitively coupled, said method comprising applying a first voltage waveform to a first end of each said first electrode having a portion defining each of the display cells in a respective row of said array that is selected for said display, during each of a sequence of addressing periods with each of said addressing periods corresponding to a different one of said rows, applying a second voltage waveform to a first end of each second electrode during at least the respective addressing periods in said sequence of addressing periods corresponding to selecting the display cells of the respective second electrode, wherein said first voltage waveform has a component that is a constant pulse extending over each said addressing period corresponding to a selected display cell, and the combined waveform across each said selected display cell, resulting from the combination of said first and second waveforms, has a change in amplitude at a later part of the respective addressing period for causing each said selected display cell to begin to emit said light after said first voltage waveform has reached the respective opposing portion thereof from said first end of the respective first electrode.

9. The method of claim 8, wherein said component of said first voltage waveform extends continuously over a plurality of successive addressing periods when respective successive ones of said display cells along the respective column are to be written, and a second constant voltage is applied to said first end of each said first electrode for each said addressing period corresponding to one of said display cells of the respective column that is not to be written.

10. The method of claim 9, wherein said second voltage waveform is a third constant level before said later part of each said addressing period corresponding to said selected display cells in the respective row, and a fourth constant level after said later part of the addressing period, to thereby provide said change in said combined amplitude.

11. The method of claim 10, wherein said third constant level is applied to said first end of each said second electrode during each of said addressing periods.

12. The method of claim 10, wherein each said second electrode is floated during each said addressing period.

13. The method of claim 10, 11 or 12, wherein said first voltage waveform consists of said constant pulse component.

14. The method of claim 9, wherein said first voltage waveform includes a further component that is a pedestal pulse and is applied in common to all of said first electrodes during said later part of each said addressing period.

15. The method of claim 14, wherein said second voltage waveform is a constant throughout the respective addressing period corresponding to the respective row.

16. The method of claim 14, wherein each said second electrode is floated electrically during each said addressing period corresponding to a different one of said rows.

* * * * *